US012429059B2

(12) United States Patent
Choi et al.

(10) Patent No.: US 12,429,059 B2
(45) Date of Patent: Sep. 30, 2025

(54) FAN MOTOR

(71) Applicant: LG Electronics Inc., Seoul (KR)

(72) Inventors: Joongkeun Choi, Seoul (KR); Jeongho Lee, Seoul (KR); Taeyong Jung, Seoul (KR); Seongho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 673 days.

(21) Appl. No.: 17/374,607

(22) Filed: Jul. 13, 2021

(65) Prior Publication Data

US 2022/0186735 A1 Jun. 16, 2022

(30) Foreign Application Priority Data

Dec. 11, 2020 (KR) ..... 10-2020-0173586

(51) Int. Cl.
*F04D 25/06* (2006.01)
*F04D 17/06* (2006.01)
(Continued)

(52) U.S. Cl.
CPC ..... *F04D 25/062* (2013.01); *F04D 17/06* (2013.01); *F04D 17/165* (2013.01);
(Continued)

(58) Field of Classification Search
CPC ..... F04D 25/062; F04D 17/06; F04D 17/165; F04D 25/0606; F04D 29/329;
(Continued)

(56) References Cited

U.S. PATENT DOCUMENTS

2014/0023510 A1* 1/2014 Ruck ..... F04D 29/30 416/223 R
2014/0328684 A1* 11/2014 King ..... F04D 29/056 416/95

(Continued)

FOREIGN PATENT DOCUMENTS

GB 2573813 A * 11/2019 ..... A47L 5/22
JP 5806758 11/2015

(Continued)

OTHER PUBLICATIONS

Extended European Search Report in European Appln. No. 21178666.0, dated Jan. 12, 2022, 7 pages.

(Continued)

*Primary Examiner* — Essama Omgba
*Assistant Examiner* — Lilya Pekarskaya
(74) *Attorney, Agent, or Firm* — Fish & Richardson P.C.

(57) ABSTRACT

A fan motor includes a housing, a stator assembly disposed inside the housing, a rotor assembly rotatably disposed inside the stator assembly, an impeller configured to generate a flow of air in the housing based on receiving power from the rotor assembly, a first housing cover disposed at one side of the housing, a first bearing disposed in the first housing cover, a second housing cover disposed at another side of the housing and configured to guide the air along an axial direction of the impeller, a second bearing disposed in the second housing cover, and a vane disposed at a lower portion of the second housing cover and configured to guide the air in the second housing cover. The impeller is a diagonal flow impeller, and the second housing cover is arranged along the axial direction.

7 Claims, 7 Drawing Sheets

(51) Int. Cl.
*F04D 17/16* (2006.01)
*F04D 25/08* (2006.01)
*F04D 29/32* (2006.01)

(52) U.S. Cl.
CPC ..... *F04D 25/0606* (2013.01); *F04D 25/08* (2013.01); *F04D 29/329* (2013.01)

(58) Field of Classification Search
CPC .. F04D 25/082; F04D 29/444; F04D 29/5806; F04D 25/08; H02K 9/06; H02K 7/14
See application file for complete search history.

(56) References Cited

U.S. PATENT DOCUMENTS

2018/0076684 A1* 3/2018 Hwang ..... A47L 9/0081
2020/0059133 A1* 2/2020 Okubo ..... F04D 29/4253
2020/0124055 A1* 4/2020 Choi ..... F04D 17/168
2021/0010486 A1* 1/2021 Choi ..... F04D 25/0606
2021/0207617 A1* 7/2021 Johnson ..... F04D 17/06

FOREIGN PATENT DOCUMENTS

| | | |
|---|---|---|
| JP | 2020143589 | 9/2020 |
| KR | 10-2020-0044737 A | 4/2020 |
| KR | 102171454 | 10/2020 |
| TW | 202021522 | 6/2020 |
| WO | WO2019220071 | 11/2019 |

OTHER PUBLICATIONS

Office Action in Taiwanese Appln. No. 110123754, dated Sep. 30, 2022, 17 pages (with English translation).
Office Action in Korean Appln. No. 10-2020-0173586, mailed on Nov. 14, 2024, 5 pages.

* cited by examiner

FAN MOTOR

CROSS-REFERENCE TO RELATED APPLICATION

Pursuant to 35 U.S.C. § 119(a), this application claims the benefit of the earlier filing date and the right of priority to Korean Patent Application No. 10-2020-0173586, filed on Dec. 11, 2020, the contents of which are incorporated by reference herein in their entirety.

TECHNICAL FIELD

The present disclosure relates to a fan motor capable of rotating a fan at a high speed.

BACKGROUND

A motor or electric motor is an apparatus that can generate rotational force using electric energy.

Electric motors can be used in a home appliance such as a vacuum cleaner and a hair dryer. In some examples, the electric motor may be coupled to a fan that generates an air current when being rotated by receiving power from the electric motor.

In some cases, the vacuum cleaner or the hair dryer may be held and used in one or both hands, and its size and weight reduction may be related to portability and convenience of use.

For instance, the vacuum cleaner or the hair dryer may have a small size and/or light weight, a relatively fast "high-speed rotation" of a fan may generate a target air volume. In some cases, the cooling performance and the reliability of a bearing may be achieved when the electric motor is rotated at a high speed.

In some cases, a fan motor may include a housing and a mount that define a flow path or passage of air, and the air that has passed through a centrifugal diffuser may cool an inside of a motor through an opening (or gap) in a lower end of the diffuser. The air may be then discharged to an outside of the motor through an outlet.

In some cases, the flow path of air introduced into the motor through an impeller inlet may be parallel to a rotating shaft, and the flow path of air may be bent to discharge through an impeller outlet. The flow path may be again rapidly changed after passing through a vane assembly.

In some cases, a flow loss of air may be excessively increased as the flow path of air rapidly changes the flow direction multiple times.

In some cases, where air is introduced from an outside without passing through the motor, cooling of the motor rotating at a high speed may be difficult.

A flow loss of a fan motor can be caused when an air flow path is significantly bent or changed. Thus, the air flow path may be designed to achieve the size and weight reduction of the motor and effectively cool the motor for high-speed rotation while achieving a structural stability.

SUMMARY

One aspect of the present disclosure is directed to minimizing a change of an air flow path inside a housing and reducing an entire length of the air flow path to minimize an air flow loss.

The present disclosure describes a fan motor that can reduce or prevent interference in the flow of air by reducing a radial length of a vane to thereby achieve the size and weight reduction of the fan motor.

The present disclosure also describes a fan motor that can allow air introduced from the outside as a motor is rotated at a high speed to come in contact with the motor by changing a flow path of the air, thereby cooling the motor in a more efficient manner.

The present disclosure further describes a fan motor that can achieve reliability by securely supporting bearings that are respectively installed at both ends of a rotor assembly by a housing cover.

According to one aspect of the subject matter described in this application, a fan motor includes a housing, a stator assembly disposed inside the housing, a rotor assembly rotatably disposed inside the stator assembly, an impeller configured to generate a flow of air in the housing based on receiving power from the rotor assembly, a first housing cover disposed at one side of the housing, a first bearing disposed in the first housing cover, a second housing cover disposed at another side of the housing and configured to guide the air along an axial direction of the impeller, a second bearing disposed in the second housing cover, and a vane assembly disposed at a lower portion of the second housing cover and configured to guide the air in the second housing cover. The impeller is a diagonal flow impeller, and the second housing cover is arranged along the axial direction.

Implementations according to this aspect can include one or more of the following features. For example, the second housing cover can accommodate and support the second bearing, where the second housing cover is fixed at an inside of the housing and disposed at a downstream side relative to the impeller in a flow direction of the air. In some examples, the impeller can be configured to supply the air toward the second housing cover through the stator assembly and the rotor assembly.

In some implementations, the second housing cover can include an outer cover, a first inner hub disposed inside the outer cover, a bearing accommodating portion that protrudes from one side of the first inner hub toward the impeller and accommodates the second bearing, and a plurality of housing cover blades that have a helical shape and protrude from an outer circumferential surface of the first inner hub to an inner circumferential surface of the outer cover to thereby connect the first inner hub to the outer cover. In some examples, the plurality of housing cover blades radially extend and are inclined toward the housing by a predetermined angle with respect to the inner circumferential surface of the outer cover, where each of the plurality of housing cover blades can be configured to guide the flow of air generated by the impeller.

In some examples, the vane assembly can include a second inner hub accommodated in the first inner hub and a plurality of vane blades that have a helical shape and protrude from an outer circumferential surface of the second inner hub toward the inner circumferential surface of the outer cover.

In some implementations, the first housing cover can be coupled to the housing at an upstream end in the flow direction of the air, and the first housing cover can be disposed at an upstream side relative to the impeller in the flow direction of the air. The first housing cover can include a first bearing accommodating portion having a recess that accommodates the first bearing. In some examples, the first housing cover can further include an outer ring portion that defines an edge of the first housing cover and has a cylindrical shape with a constant height in the axial direction, and a connecting portion that radially extends from the first bearing accommodating portion and is connected to the outer ring portion.

In some examples, the first housing cover can define a plurality of axial through-holes at a position adjacent to the first bearing accommodating portion, where the impeller can be configured to receive air drawn through the plurality of axial through-holes. In some examples, each of the plurality of axial through-holes penetrates through the connecting portion and is defined between the outer ring portion and the connecting portion.

In some implementations, the second housing cover can include a plurality of housing cover blades, and the vane assembly can include a vane hub having a cylindrical shape and a plurality of vane blades disposed along an outer surface of the vane hub, where each of the plurality of vane blades is disposed at a position corresponding to a position of one of the plurality of housing cover blades. In some implementations, the impeller can include a hub having a cylindrical shape and a plurality of impeller blades that protrude from an outer circumferential surface of the hub.

In some implementations, each of the first bearing and the second bearing can be a ball bearing and include an O-ring disposed at an outer surface thereof. In some implementations, the impeller, the rotor assembly, and the stator assembly are located between the first bearing and the second bearing along the axial direction. In some examples, the fan motor can be configured to discharge, to an outside of the fan motor, the air that has sequentially passed through the first housing cover, the first bearing, the rotor assembly or the stator assembly, the impeller, and the second housing cover.

In some implementations, the housing can include a first accommodating portion that accommodates the rotor assembly and the stator assembly, a second accommodating portion that is disposed vertically below the first accommodating portion and accommodates the impeller, a neck portion disposed between the first accommodating portion and the second accommodating portion, where a diameter of the neck portion is less than a diameter of the first accommodating portion, and an inclined portion that is inclined with respect to the first accommodating portion and extends from the first accommodating portion toward the neck portion.

In some implementations, the inclined portion can have a tapered shape such that a diameter of the inclined portion decreases from the first accommodating portion toward the neck portion. In some examples, an inclination angle ($\theta$) of the inclined portion with respect to a radial direction is determined by (i) a half value (D3) of a difference between an inner diameter (D1) of the first accommodating portion and an inner diameter (D2) of the neck portion and (ii) a height difference (H) between an upper end of the inclined portion facing the first accommodating portion and a lower end of the inclined portion facing the neck portion. For example, the inclination angle $\theta$ of the inclined portion is determined by Equation $\theta=\tan^{-1}(H/D3)$, where $D3=(D1-D2)/2$.

In some implementations, the housing can include a first flange that protrudes radially outward from a lower end of the housing, and the second housing cover can include a second flange that protrudes radially outward, where the second flange overlaps with the first flange and is in contact with the first flange.

In some implementations, the fan motor can have a structure in which an axial flow vane is installed in a rear position of a diagonal flow impeller. As the axial flow vane is employed in the fan motor, an air flow path may not be greatly or significantly changed compared to when a diagonal flow vane is applied. In addition, a total length of the air flow path can be reduced, allowing a flow loss to be minimized. A neck portion can be disposed at a housing to reduce a cross-sectional area of the air flow. This can allow the flow velocity of air to be increased to thereby increase a suction speed. This can also result in facilitating the flow of air to thereby further reduce the flow loss.

In some examples, the second housing cover can serve as an axial flow vane, and a radial length of the vane can be reduced compared to when a diagonal flow vane is applied. This can allow the size and weight of the fan motor to be reduced, and prevent or reduce air interference while flowing.

In some implementations, the second housing cover can be disposed parallel to the axial direction, and a mold of the second housing cover can be more easily removed in an up-and-down direction. This can lead to a simpler manufacturing process of the second housing cover, allowing economic feasibility of mass production to be achieved.

In some examples, where the fan motor rotates at a high speed, for example, at 100,000 rpm or higher, air introduced as the impeller rotates can first come into contact with a stator assembly and a rotor assembly to be cooled, thereby achieving more efficient cooling performance.

In some examples, the first and second bearings installed at both ends of a rotating shaft can be supported by the first housing cover and the second housing cover, respectively. This stable support structure can increase a lifespan of the bearings for high-speed rotation of the motor. In some cases, the first bearing and the second bearing can respectively support the both ends of the rotating shaft and be located far from each other according to the motor design.

DETAILED DESCRIPTION

Figure 1:
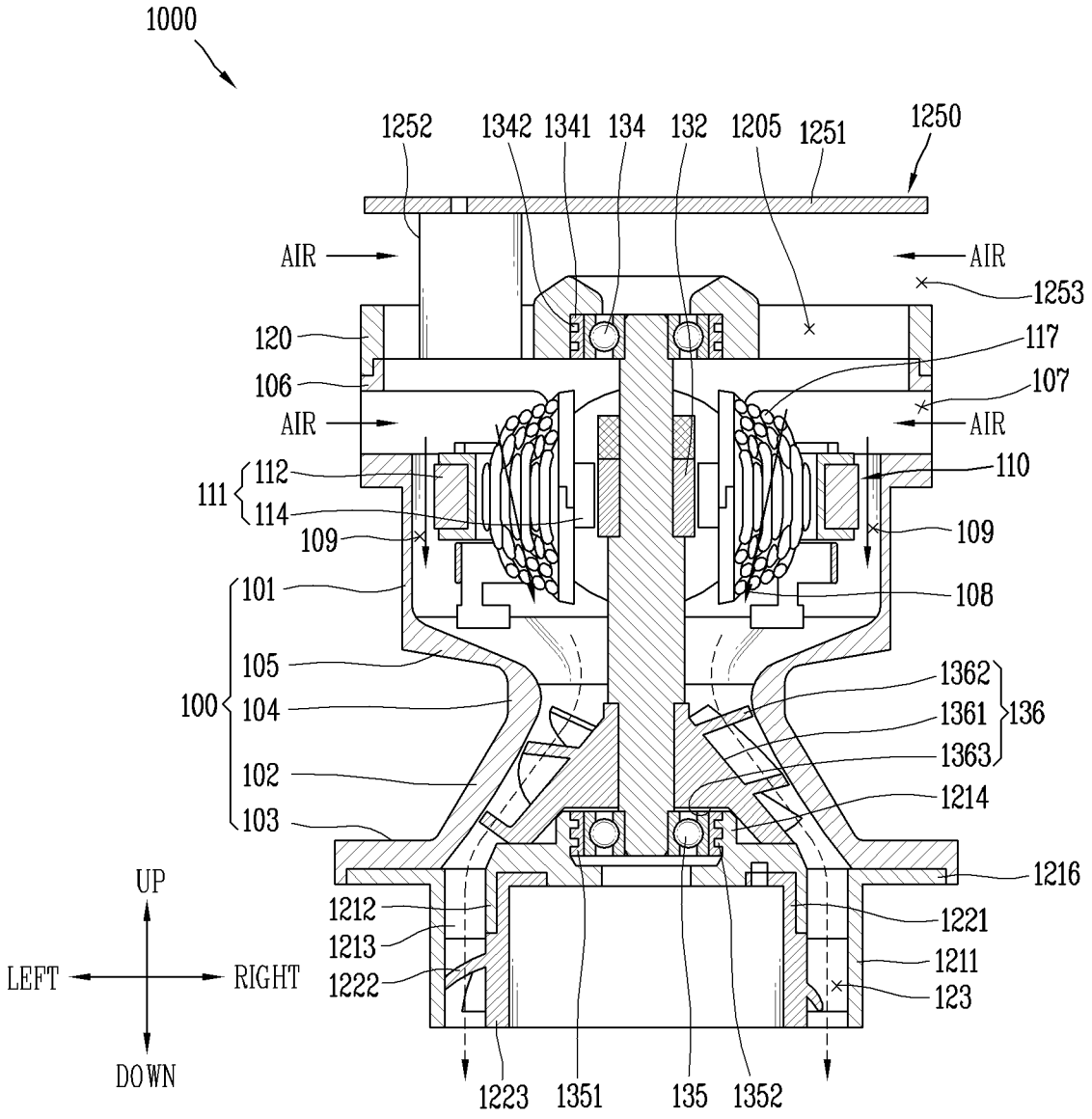
FIG. 1 is a longitudinal cross-sectional view illustrating an example of a fan motor.

Hereinafter, one or more implementations of a fan motor will be described in detail with reference to the accompanying drawings.

Herein, the same or similar elements are designated with the same or similar reference numerals, and a redundant description has been omitted.

In addition, even if different implementations do not contradict structurally and functionally, the structure applied to one implementation can be equally applied to another implementation.

The term "motor" used herein refers to a device that can convert energy, such as electricity, into mechanical energy, for example, an electric motor, etc. The term "fan motor" refers to a motor that can generate an air current by rotating a fan.

For instance, the motor can provide power for suctioning air into a vacuum cleaner or for transferring air to a specific location in a hair dryer, etc.

The term "upper" or "up" (see FIGS. 1 and 2) used herein refers to an upper part or side in an up-and-down direction of the drawings, and the term "lower" or "down" (see FIGS. 1 and 2) refers to a lower part or side in the up-and-down direction of the drawings. The up-and-down direction can refer to a direction parallel or equal to an axial direction of a rotating shaft.

In addition, a radial direction used herein can include a front-and-rear direction (front/rear: see FIG. 2), a left-and-right direction (left/right: see FIGS. 1 and 2), or any combination thereof.

Figure 2:
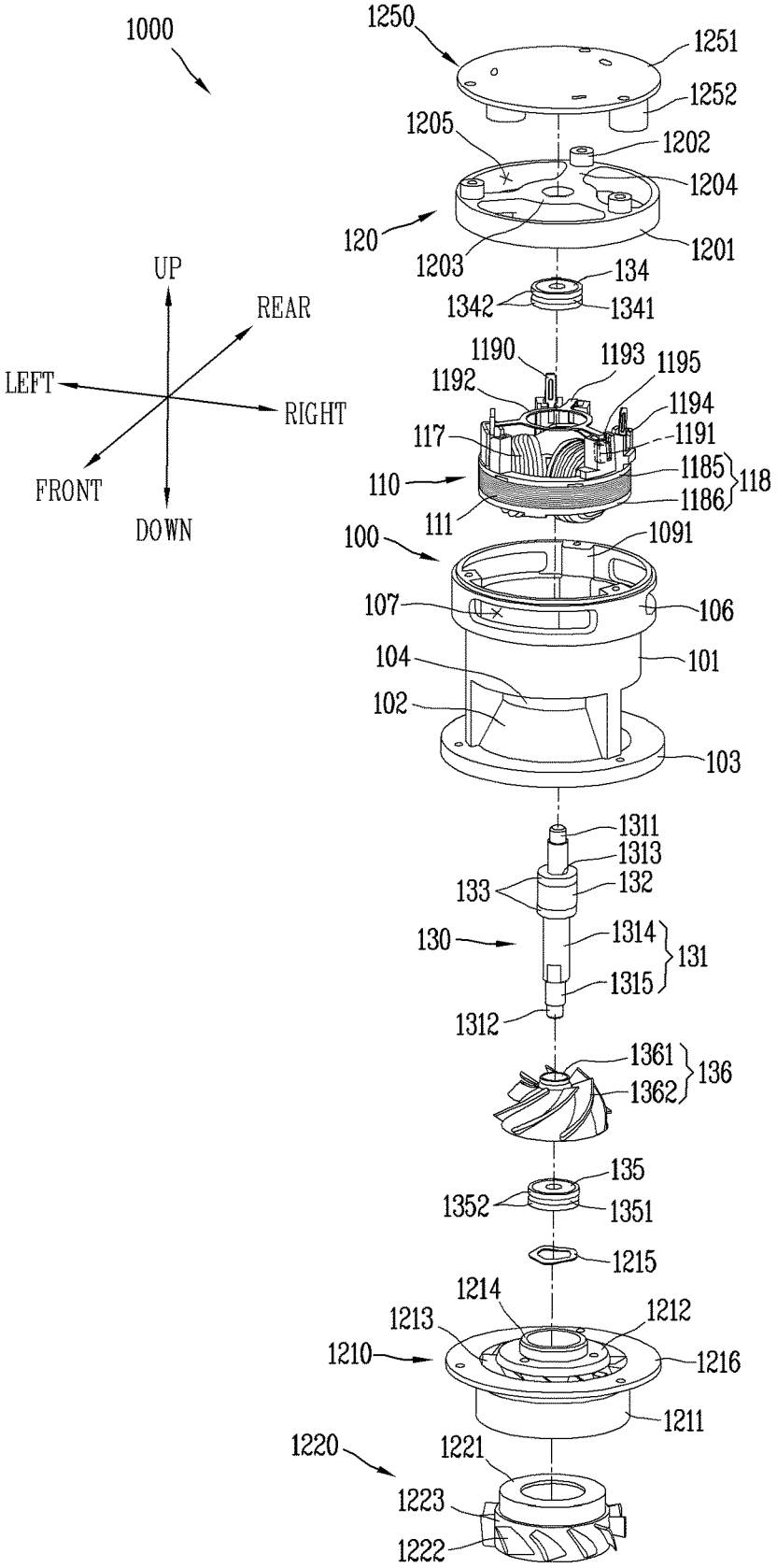
FIG. 2 is an exploded perspective view illustrating the fan motor.

FIG. 1 is a longitudinal cross-sectional view illustrating an example of a fan motor 1000, and FIG. 2 is an exploded perspective view of the fan motor 1000.

In some implementations, the fan motor 1000 can include a housing 100, a stator assembly 110, a rotor assembly 130, an impeller 136, a vane assembly 1220, and first and second bearings 134 and 135, and first and second housing covers 120 and 1210.

The housing 100 that defines an outer appearance of the fan motor 1000 can have a circular cross section.

The housing 100 can be provided therein with an accommodation space and serve to produce a flow of air along a lengthwise direction (up-and-down direction in the drawing or axial direction).

Air suctioned into the housing 100 from an upper part of the housing 100 passes through a neck portion having a decreasing cross-sectional area. As the flow velocity of air increases from the neck portion, an air intake or suction speed can be increased. The neck portion is formed between a first accommodating portion 101 and a second accommodating portion 102 of the housing 100. The neck portion can also be referred to as a bottleneck portion. A detailed description thereof will be described hereinafter.

The housing 100 can include the first accommodating portion 101, the second accommodating portion 102, and a neck portion 104.

The first accommodating portion 101 can have a cylindrical shape and be disposed at an upper portion of the housing 100. A center of the first accommodating portion 101 that defines a center of the housing 100 can be located to correspond to a center of a rotating (or rotational) shaft 131.

The first accommodating portion 101 can be provided therein with an accommodation space in which the rotor assembly 130 and the stator assembly 110 are accommodated.

A diameter of the first accommodating portion 101 can be constant in the up-and down direction. The first accommodating portion 101 can have a constant cross-sectional area in a radial direction.

An intake port (or inlet) 106 can be formed at an upper portion of the first accommodating portion 101. The intake port 106 can be integrally formed on the upper portion of the first accommodating portion 101 and be configured to suction air into the housing 100. The intake port 106 can communicate with an outside of the housing 100.

The intake port 106 can have a circular ring shape. A diameter of the intake port 106 can be greater than the diameter of the first accommodating portion 101. An upper portion of the intake port 106 can radially extend outward from an upper end of the first accommodating portion 101 in a stepped manner to thereby have a larger diameter.

A plurality of side holes 107 can be formed at the intake port 106, and the plurality of side holes 107 can be formed through a circumferential surface of the intake port 106 in the radial direction. The plurality of side holes 107 can be spaced apart from one another in a circumferential direction of the intake port 106.

The plurality of side holes 107 can extend along the circumferential direction of the intake port 106. The side hole 107 can be longer in the circumferential direction than in the up-and-down direction.

The plurality of side holes 107 can be spaced apart from each other at equal intervals in the circumferential direction of the intake port 106. Here, the interval between the side holes 107 can be less than a length of the side hole 107.

The side hole 107 can have a rectangular shape in the radial direction when viewed from an outer surface of the housing 100. Each vertex (or corner) of the side hole 107 can be curved to have rounded corners.

The intake port 106 can penetrate in the up-and-down direction. Air outside the housing 100 can be introduced through the intake port 106 and flow in the radial direction through the plurality of side holes 107, allowing the air to be introduced into the housing 100. In addition, air can be axially introduced into the housing 100 from an upper part of the intake port 106.

The neck portion 104 formed at the housing 100 can be disposed between the first accommodating portion 101 and the second accommodating portion 102. A diameter of the neck portion 104 can be less than the diameter of the first accommodating portion 101. Accordingly, the flow velocity of air flowing from the first accommodating portion 101 to the second accommodating portion 102 can be increased while passing through the neck portion 104.

An inclined portion 105 can be provided between a lower end of the first accommodating portion 101 and the neck portion 104. The inclined portion 105 can have a diameter that gradually decreases from the first accommodating portion 101 toward the neck portion 104.

The second accommodating portion 102 can have a conical shape. The second accommodating portion 102 can have a shape with a decreasing diameter from the top to the bottom. For example, an upper end of the second accommodating portion 102 can be smaller in diameter than a lower end of the second accommodating portion 102.

A first flange 103 can be formed at the lower end of the second accommodating portion 102. The first flange 103 can have a ring shape and extend radially outward from the lower end of the second accommodating portion 102. For example, the first flange 103 can protrude radially outward from the lower end of the second accommodating portion 102.

The impeller 136 can be accommodated in the second accommodating portion 102. The impeller 136 serves to form a flow of air through a rotational force generated by the rotor assembly 130 and the stator assembly 110.

The impeller 136 can be mounted to one side of the rotating shaft 131, so as to rotate together with the rotating shaft 131.

The impeller 136 that serves to produce a flow of air by receiving power from the motor through the rotating shaft 131 can suction air introduced into the first accommodating portion 101 into the second accommodating portion 102.

The impeller 136 can include an impeller hub 1361 and a plurality of blades 1362. As illustrated in FIG. 2, the impeller 136 can be configured as a diagonal flow type. In the diagonal flow impeller, air is suctioned along the axial direction and discharged in an inclined manner with respect to the axial direction. For example, the diagonal flow impeller 136 can discharge radially outward with respect to a rotational axis of the impeller 136 and axially downward along the rotational axis of the impeller 136.

The impeller 136 configured as the diagonal flow type has a conical shape, that is, the impeller hub 1361 of the impeller 136 can have a conical shape with a decreasing diameter from the top toward the bottom.

The impeller 136 configured as the diagonal flow type has a fluid flow direction that corresponds between a fluid flow direction of a centrifugal impeller and a fluid flow direction of an axial flow impeller, and the plurality of blades 1362 has an inclination (or slope) of an approximately 45 degrees with respect to a rotation direction of the impeller 136 and the axial direction. The fluid flow direction is formed along an outer surface of the impeller hub 1361. As for the axial flow impeller, air is suctioned along the axial direction and is discharged along the axial direction.

The impeller hub 1361 can have a diameter that gradually increases from the top to the bottom, and the outer surface of the impeller hub 1361 can be inclined at a predetermined angle.

The impeller hub 1361 can be provided therein with a shaft coupling portion that has a cylindrical shape and is formed therethrough in the axial direction.

One side of the rotating shaft 131 is inserted into the shaft coupling portion, allowing the impeller 136 to rotate together with the rotating shaft 131.

The plurality of blades 1362 can each protrude from the outer surface of the impeller hub 1361 toward an inner surface of the second accommodating portion 102. The plurality of blades 1362 can each extend from the outer surface of the impeller hub 1361 in a helical direction at a predetermined wrap angle. Here, the wrap angle refers to an angle formed by a length of the blade 1362 extending from the outer surface of the impeller hub 1361 in the circumferential direction. The smaller the wrap angle of the blade 1362, the less the air flow resistance of the impeller 136.

The wrap angle of the blade 1362 can be 90 degrees or less to reduce the air flow resistance. In this case, the impeller 136 can be rotated relative to the second accommodating portion 102 by a rotational force of the motor, allowing air between the blades 1362 to be rotated. The rotating air can move from the upper end to the lower end of the second accommodating portion 102 along a flow path or passage between the outer surface of the impeller hub 1361 and the inner surface of the second accommodating portion 102.

In some implementations, the fan motor 1000 can include the first housing cover 120 mounted on one side of the housing 100 and in which the first bearing 134 is provided, and the second housing cover 1210 mounted on another side of the housing 100 and in which the second bearing 135 is provided.

The first housing cover 120 and the second housing cover 1210 can be installed at the upper and lower portions of the housing 100, respectively.

The first housing cover 120 can have a circular ring shape and be mounted to the upper portion of the housing 100, namely, to the upper portion of the intake port 106 of the housing 100.

The first housing cover 120 can include an outer ring portion (or outer ring) 1201, a first bearing accommodating portion 1203, and a plurality of connecting portions 1204.

The outer ring portion 1201 can define an outer edge surface of the first housing cover 120.

The first bearing accommodating portion 1203 can be formed at a central portion or part of the outer ring portion 1201 and have a cylindrical shape. The first bearing accommodating portion 1203 has an accommodation space in which the first bearing 134 is accommodated.

The first bearing accommodating portion 1203 can have the same height (thickness) as the outer ring portion 1201. An axial through-hole 1205 can be formed at an upper portion of the first bearing accommodating portion 1203. The first bearing accommodating portion 1203 surrounds and supports an outer circumferential surface of the first bearing 134.

In some implementations, the first bearing 134 can be configured as a ball bearing, and a first holder 1341 can be installed on the outer circumferential surface of the first bearing 134. The first holder 1341 can have a cylindrical shape.

A first O-ring 1342 can be installed on an outer circumferential surface of the first holder 1341. The first O-ring 1342 can be provided in plurality.

The plurality of first O-rings 1342 can be spaced apart from each other in a lengthwise direction of the first holder 1341. A first O-ring mounting groove can be formed on the outer circumferential surface of the first holder 1341 so as to allow the first O-ring 1342 to be inserted and fixed therein.

The first O-ring 1342 can be disposed between an inner circumferential surface of the first bearing accommodating portion 1203 and the outer circumferential surface of the first holder 1341 in a close contact manner.

The first O-ring 1342 can have a circular cross-sectional shape, and at least a portion or part of the circular cross-section of the first O-ring 1342 can protrude from the first O-ring mounting groove, so as to be in close contact with the inner circumferential surface of the first bearing accommodating portion 1203.

The first O-ring 1342 can be made of an elastic material. The first O-ring 1342 can serve to adjust the concentricity of two bearings that respectively support both ends of the rotating shaft 131, and attenuate vibration and impact transferred to the first bearing 134 to thereby achieve the reliability of the bearing.

When the rotating shaft 131 rotates, the first O-ring 1342 can absorb vibration and reduce impact transferred to the first bearing 134, allowing the vibration and impact to be attenuated.

A diameter of the first bearing accommodating portion 1203 can be less than a diameter of the outer ring portion 1201.

The connecting portion 1204 can be formed between the outer ring portion 1201 and the first bearing accommodating portion 1203.

The connecting portion 1204 radially extends between the outer ring portion 1201 and the first bearing accommodating portion 1203 to connect the outer ring portion 1201 and the first bearing accommodating portion 1203.

The connecting portion 1204 can have a rectangular cross-sectional shape.

The plurality of the connecting portions 1204 can be disposed to be spaced apart from one another in a circumferential direction of the outer ring portion 1201. In some implementations, three connecting portions 1204 are provided.

For example, the plurality of connecting portions 1204 can be disposed to be spaced apart from one another at equal intervals in the circumferential direction of the outer ring portion 1201 and be formed in the shape of three bridges, allowing three air inlet holes (axial through-holes) can be formed between the outer ring portion 1201 and the connecting portions 1204.

The first housing cover 120 can include a plurality of axial through-holes 1205. The plurality of axial through-holes 1205 can penetrate between the plurality of connecting portions 1204 in the axial direction (or up-and-down direction).

Air outside the housing 100 can be introduced into the housing 100 through the plurality of axial through-holes 1205.

A plurality of first coupling portions 1202 can be formed on the outer ring portion 1201 in a manner of protruding upward. The first coupling portion 1202 can be disposed on an extended line of the connecting portion 1204. The first coupling portion 1202 can have a protruding cylindrical shape.

The fan motor 1000 can include the second housing cover 1210.

The second housing cover 1210 is mounted to the lower portion of the housing 100. A second bearing accommodating portion 1214 is formed at the second housing cover 1210, and the second housing cover 1210 accommodates and supports the second bearing 135.

The second housing cover 1210 is fixedly installed inside the housing 100 beneath the impeller 136.

The second housing cover 1210 can have a structure that can serve as an axial flow vane. That is, the impeller 136 configured as the diagonal flow type and the second housing cover 1210 can be arranged vertically. In this case, the second housing cover 1210 that serves as the axial flow vane can be provided in a lower position of the impeller 136 configured as the diagonal flow type. For example, the second housing cover 1210 can guide and discharge the air along the axial direction of the impeller 136, where the air may not be discharged radially outward with respect to the axial direction.

As the second housing cover 1210 has a structure of the axial flow vane, the fan motor 1000 can have a reduced radial length, and thus, a length of air flow path can be reduced than when a diagonal flow vane is applied. In addition, a change in air flow angle caused when an air flow path is bent as air flowing along the impeller 136 passes through the second housing cover 1210 can be minimized, thereby reducing interference due to the flow of air.

The fan motor 1000 can include the stator assembly 110 that is installed inside the housing 100 and the rotor assembly 130 that is rotatably mounted inside the stator assembly 110.

The rotor assembly 130 can include the rotating shaft 131, a permanent magnet 132, and a plurality of end plates 133.

The rotating shaft 131 can extend to cross a center of the housing 100 in the axial direction, and the center of the rotating shaft 131 can coincide with the center of the housing 100.

The rotating shaft 131 can include first and second bearing support portions 1311 and 1312, a permanent magnet mounting portion 1313, a shaft extension portion 1314, and an impeller mounting portion 1315.

The first and second bearing support portions 1311 and 1312 can be provided at both ends of the rotating shaft 131. The first bearing support portion 1311 can be disposed at an upper end of the rotating shaft 131, namely, at an upstream side of the permanent magnet mounting portion 1313 with respect to a flow direction of air.

The second bearing support portion 1312 can be disposed at a lower end of the rotating shaft 131, namely, at a downstream side of the impeller mounting portion 1315 with respect to the flow direction of air.

The bearings 134 and 135 can be configured as a first bearing 134 and a second bearing 135, respectively, and the both ends of the rotating shaft 131 are rotatably supported by the first bearing 134 and the second bearing 135.

The first bearing support portion 1311 can be coupled to the first bearing 134 by penetrating through a central hole thereof, and be supported by the first bearing 134. The second bearing support portion 1312 can be coupled to the second bearing 135 in a manner of penetrating through a central hole thereof, and be supported by the second bearing 135.

The permanent magnet mounting portion 1313 can be formed downward from the first bearing support portion 1311 to be slightly larger in diameter than the first bearing support portion 1311. The permanent magnet mounting portion 1313 can be disposed at a downstream side of the first bearing support portion 1311 with respect to the flow direction of air.

An entire length of the permanent magnet mounting portion 1313 can be greater than an entire length of the first bearing support portion 1311.

A shaft receiving hole can be axially formed through a center of the permanent magnet 132.

The permanent magnet mounting portion 1313 can penetrate through the shaft receiving hole.

The permanent magnet mounting portion 1313 can be longer in length than the permanent magnet 132. The permanent magnet 132 can slide along the permanent magnet mounting portion 1313 in the axial direction and be mounted to the permanent magnet mounting portion 1313.

In order to limit or suppress axial movement of the permanent magnet 132 from the permanent magnet mounting portion 1313, a plurality of end plates 133 can be disposed at upper and lower portions of the permanent magnet 132, respectively. With respect to the flow direction of air, the plurality of end plates 133 can be disposed at upstream and downstream sides of the permanent magnet 132, respectively, thereby suppressing axial movement of the permanent magnet 132.

The shaft extension portion 1314 disposed at a downstream side of the permanent magnet mounting portion 1313 with respect to the flow direction of air can extend in the axial direction to be larger in diameter than the permanent magnet mounting portion 1313.

When the diameter of the shaft extension portion 1314 is greater than the diameter of the permanent magnet mounting portion 1313, axial movement of the permanent magnet 132 in a downward direction can be suppressed, and thus, any one of the plurality of end plates 133 can be excluded.

The impeller mounting portion 1315 can be extend downward from the shaft extension portion 1314 to be smaller in diameter than the shaft extension portion 1314.

As the impeller mounting portion 1315 is coupled to the shaft coupling portion of the impeller 136 in a penetrating manner, the impeller 136 can be mounted to the impeller mounting portion 1315.

A recessed portion 1363 can be formed at a lower portion of the impeller hub 1361 in a recessed manner, and the second bearing accommodating portion 1214 of the second housing cover 1210 can be formed inside the recessed portion 1363.

The recessed portion 1363 of the impeller 136 can cover the second bearing accommodating portion 1214 and the second bearing 135. Owing to the recessed portion 1363, it is possible to suppress the second bearing 135 from being separated from the second bearing accommodating portion 1214.

Further, as the recessed portion 1363 of the impeller 136 is configured to cover the second bearing accommodating portion 1214 and the second bearing 135, it is possible to prevent dust and other foreign substances contained in the air from being introduced into a gap between the second bearing accommodating portion 1214 and the second bearing 135.

In the case of the present disclosure, a rotating magnetic field can be produced around the rotor using a three-phase AC motor with 3 different phases.

The stator assembly 110 can include a stator core 111 and a plurality of stator coils 117, and the plurality of stator coils 117 can be wound around the stator core 111.

In some implementations, three stator coils 117 can be wound around the stator core 111, as illustrated in FIG. 2.

A three-phase (e.g., U phase, V phase, and W phase) AC power source can be connected to the three stator coils 117, so as to apply AC power to the stator coil 117. When the AC power is applied to the stator coil 117, a rotating magnetic field is generated around the rotor, allowing the rotor to rotate.

The stator core 111 can include a back yoke 112 and a plurality of teeth 114.

The back yoke 112 can have a hollow cylindrical shape, and the plurality of teeth 114 can be installed inside the back yoke 112.

The plurality of stator coils 117 can be wound around the plurality of teeth 114, respectively. Here, the number of teeth 114 can correspond to the number of stator coils 117.

The plurality of teeth 114 can be disposed to be spaced apart from one another in a circumferential direction of the back yoke 112.

A plurality of inner or internal flow paths can be formed inside the back yoke 112 in a manner of penetrating in an axial direction of the stator core 111. Accordingly, air introduced into the first accommodating portion 101 of the housing 100 can pass through the stator assembly 110 along the plurality of internal flow paths.

An insulator 118 can be provided between the stator core 111 and the stator coil 117. The insulator 118 includes an upper insulator 1185 and a lower insulator 1186.

The insulator 118 provides electrical insulation between the stator core 111 and the stator coil 117.

A plurality of power terminals 1190 can be respectively connected to one end portions (or ends) of the plurality of stator coils 117, so as to supply 3-phase AC power.

A plurality of neutral conductor terminals 1191 can be connected to the other end portions of the plurality of stator coils 117. The plurality of neutral conductor terminals 1191 connects the other end portions of the three-phase stator coils 117, respectively.

A terminal mounting part can be formed at an outer end portion of the upper insulator 1185. The terminal mounting part includes a power terminal mounting portion 1194 and a neutral conductor terminal mounting portion 1195.

The power terminal mounting portion 1194 and the neutral conductor terminal mounting portion 1195 can each have an accommodation space therein, allowing the power terminal 1190 and the neutral conductor terminal 1191 to be mounted on the power terminal mounting portion 1194 and the neutral conductor terminal mounting portion 1195, respectively.

The power terminal mounting portion 1194 and the neutral conductor terminal mounting portion 1195 can be separated from each other by a partition wall. The power terminal 1190 can be mounted on the power terminal mounting portion 1194, so as to be connected to one end portion of the stator coil 117. The neutral conductor terminal 1191 can be mounted on the neutral conductor terminal mounting portion 1195, so as to be connected to another end portion of the stator coil 117.

The plurality of neutral conductor terminals 1191 can be connected by a connection ring 1192. The connection ring 1192 can have a circular ring shape.

A plurality of connection bars 1193 can be provided at the connection ring 1192. The plurality of connection bars 1193 can extend radially outward from an outer circumferential surface of the connection ring 1192. The connection bar 1193 can be bent in the axial direction so as to be connected to the neutral conductor terminal 1191. The plurality of neutral conductor terminals 1191 can be connected by the plurality of connection bars 1193 and the connection ring 1192.

As the rotor assembly 130 is disposed inside the stator assembly 110 with an air gap, the rotor assembly 130 can be rotated with respect to the stator assembly 110.

A rotor receiving hole is provided at an inner central portion of the stator core 111.

The permanent magnet 132 can be disposed in the rotor receiving hole.

The stator assembly 110 and the rotor assembly 130 can be disposed between the first bearing 134 and the second bearing 135.

As the stator assembly 110 and the rotor assembly 130 electromagnetically interact with each other, the rotor assembly 130 can be rotated with respect to the stator assembly 110.

The three stator coils 117 can produce a rotating magnetic field around the permanent magnet 132 by receiving 3-phase AC power.

The permanent magnet 132 is rotated by the rotating magnetic field, and the permanent magnet 132 and the rotating shaft 131 can be rotated integrally with each other.

In some implementations, the impeller 136 can be disposed between the first bearing 134 and the second bearing 135.

As the rotor assembly 130 and the impeller 136 are disposed between the first bearing 134 and the second bearing 135, the both ends of the rotating shaft 131 are supported by the first bearing 134 and the second bearing 135, respectively, thereby increasing structural stability during rotation of the rotor assembly 130 and the impeller 136.

The stator assembly 110 and the rotor assembly 130 can be disposed at an upstream side of the impeller 136 with respect to the flow direction of air.

When the stator assembly 110 and the rotor assembly 130 are disposed at the upstream side of the impeller 136, cold air outside the housing 100 passes through an internal flow path 108 of the stator assembly 110 before being suctioned into the impeller 136, thereby further enhancing cooling performance of the motor.

Since the plurality of stator coils 117, the permanent magnet 132, and the rotating shaft 131 are accommodated in the flow path formed inside the stator assembly 110, a space for air to axially pass through the internal flow path 108 is very narrow, causing a significant increase in flow resistance and flow loss. In some examples, a bypass flow path 109 can be provided outside or inside the housing 100.

The bypass flow path 109 can be formed inside the housing 100 and be formed outside the stator assembly 110.

As illustrated in FIG. 1, the bypass flow path 109 can be disposed between the housing 100 and the stator core 111.

The bypass flow path 109 can be formed inside the first accommodating portion 101 to be recessed in a thickness direction.

In addition, the bypass flow path 109 can be provided in plurality inside the first accommodating portion 101. The number of bypass flow paths 109 can correspond to the number of windings of the stator coil 117.

The vane assembly 1220 is disposed at a lower portion of the second housing cover 1210 and serves to guide a flow of air moving from the impeller 136.

The vane assembly 1220 can include a vane hub 1223 having a cylindrical shape and a plurality of vane blades 1222 formed along an outer surface of the vane hub 1223 with the cylindrical shape.

The vane hub 1223 can have a hollow cylindrical shape.

The vane hub 1223 can be disposed in series with a first inner hub 1212 in the axial direction.

The vane hub 1223 can be mounted to a lower portion of the first inner hub 1212 and have the same diameter as the first inner hub 1212.

A center of the vane hub 1223 can coincide with a center of an outer cover 1211. In some examples, the outer cover 1211 can extend along the axial direction.

An insertion portion 1221 can be formed at an upper portion of the vane hub 1223. The first inner hub 1212 and the vane hub 1223 are coupled to each other through the insertion portion 1221. The vane hub 1223 can also be referred to as a "second inner hub" since it defines an inner hub by being coupled to the first inner hub 1212 along the axial direction. The insertion portion 1221 is formed at the upper portion of the vane hub 1223 to be smaller in diameter than the vane hub 1223.

The insertion portion 1221 can have a hollow cylinder shape. The insertion portion 1221 is inserted into the first inner hub 1212 and is coupled in an overlapping manner, allowing the first inner hub 1212 and the vane hub 1223 to be coupled to each other.

An upper portion of the insertion portion 1221 can extend radially inward. The upper portion of the insertion portion 1221 and an upper portion of the first inner hub 1212 can be disposed to overlap each other in the up-and-down direction. The upper portion of the insertion portion 1221 and the inner upper portion of the first inner hub 1212 can be coupled to each other by a fastening member such as a screw.

The plurality of vane blades 1222 can be provided in an annular space between an inner circumferential surface of the outer cover 1211 and an outer circumferential surface of the vane hub 1223. The plurality of vane blades 1222 and the vane hub 1223 can be accommodated in the outer cover 1211.

The plurality of vane blades 1222 can extend obliquely downward from the outer circumferential surface of the vane hub 1223. The vane blade 1222 can be implemented as an axial flow type.

The plurality of vane blades 1222 connects the outer cover 1211 and the vane hub 1223. An inner end of the vane blade 1222 is connected to the outer circumferential surface of the vane hub 1223, and an outer end of the vane blade 1222 is connected to the inner circumferential surface of the outer cover 1211.

The plurality of vane blades 1222 can be disposed to be spaced apart from one another in a circumferential direction of the vane hub 1223.

The plurality of vane blades 1222 can be provided between the outer cover 1211 and the vane hub 1223 in a fixed manner.

A discharge port (or outlet) 123 can be formed between the outer cover 1211 and the vane hub 1223. The discharge port 123 can be connected to communicate with the outside of the housing 100.

The discharge port 123 can discharge air, flowing from the second accommodation portion 102 to an inside of the second housing cover 1210, to the outside of the housing 100.

With this configuration, air suctioned by the impeller 136 can flow to an internal flow path of the second housing cover 1210 from the second accommodating portion 102, namely, to the annular space between the inner circumferential surface of the outer cover 1211 and the outer circumferential surface of the vane hub 1223.

When the impeller 136 rotates according to rotation of the rotating shaft 131, air is introduced through the plurality of axial through-holes 1205 of the first housing cover 120 and the plurality of side holes 107 formed at the housing 100. The introduced air flows toward the impeller 136 along the inside of the housing 100.

More specifically, as the air suctioned through the plurality of axial through-holes 1205 is introduced into the housing 100, the first bearing 134 disposed adjacent thereto can be cooled. In addition, the low-temperature air introduced through the plurality of the axial through-holes 1205 and the plurality of the side holes 107 can directly cool heat generated when the stator 142 and the rotor 141 are driven.

As a result, cooling efficiency can be increased compared to the related art method in which a stator and a rotor are cooled by air that has passed through an impeller.

In some cases, a motor may include an impeller located in an upper position or upstream relative to the rotor and the stator so that air having an increased temperature may cool the rotor and the stator. In the present disclosure, the impeller is disposed downstream relative to the rotor assembly 130 and the stator assembly 110, and thus air introduced from the outside can first cool the rotor assembly 130 and the stator assembly 110. Accordingly, the outside air before the temperature is increased can first cool the rotor assembly 130 and the stator assembly 110, thereby improving the cooling efficiency.

In some examples, an inverter 1250 can be provided at the upper portion of the housing 100.

The inverter 1250 can include a printed circuit board (PCB) 1251 and semiconductor devices mounted to the PCB 1251. The semiconductor devices can include an insulated gate bipolar transistor (IGBT), a capacitor, and the like.

The PCB 1251 can have a disk shape. The PCB 1251 can be spaced apart from the first housing cover 120 in the axial direction. The PCB 1251 can be disposed to overlap the first housing cover 120 in the axial direction.

A plurality of second coupling portions 1252 can protrude downward from a lower surface of the PCB 1251.

The second coupling portion 1252 is configured to surround and accommodate the first coupling portion 1202. The second coupling portion 1252 can have a cylindrical shape with a diameter that is greater than a diameter of the first coupling portion 1202.

An axial or vertical height of the second coupling portion 1252 can be greater than an axial or vertical height of the first coupling portion 1202.

The plurality of first and second coupling portions 1202 and 1252 can be disposed to be spaced apart from one another at equal intervals in a circumferential direction of the PCB 1251.

With this configuration, the first coupling portions 1202 and the second coupling portions 1252 are fitted together in pairs, allowing the PCB 1251 to be coupled to the first housing cover 120.

A plurality of lateral flow paths 1253 can be formed between the first housing cover 120 and the PCB 1251.

The plurality of lateral flow paths 1253 can radially penetrate between the plurality of first and second coupling portions 1202 and 1252. Heights of the plurality of lateral flow paths 1253 can be determined by heights of the first and second coupling portions 1202 and 1252. The plurality of lateral flow paths 1253 can be defined by an interval between the plurality of first and second coupling portions 1202 and 1252.

The plurality of lateral flow paths 1253 can be disposed in an upper position of the plurality of side holes 107.

The lateral flow path 1253 and the side hole 107 can overlap in the up-and-down direction or the axial direction.

The lateral flow path 1253 and the side hole 107 can be connected to communicate with the axial through-hole 1205 of the first housing cover 120.

Circumferential lengths of the lateral flow path 1253 and the side hole 107 can extend at the same angle. In addition, a circumferential length of the outermost edge portion of the axial through-hole 1205 can extend at the same angle as the circumferential lengths of the lateral flow path 1253 and the side hole 107.

Figure 3:
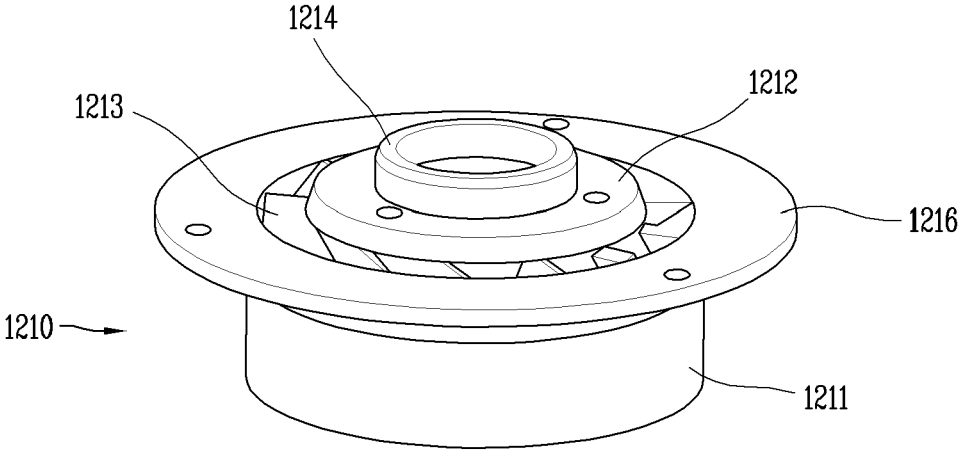
FIG. 3 is a perspective view illustrating an example of a second housing cover.
Figure 4:
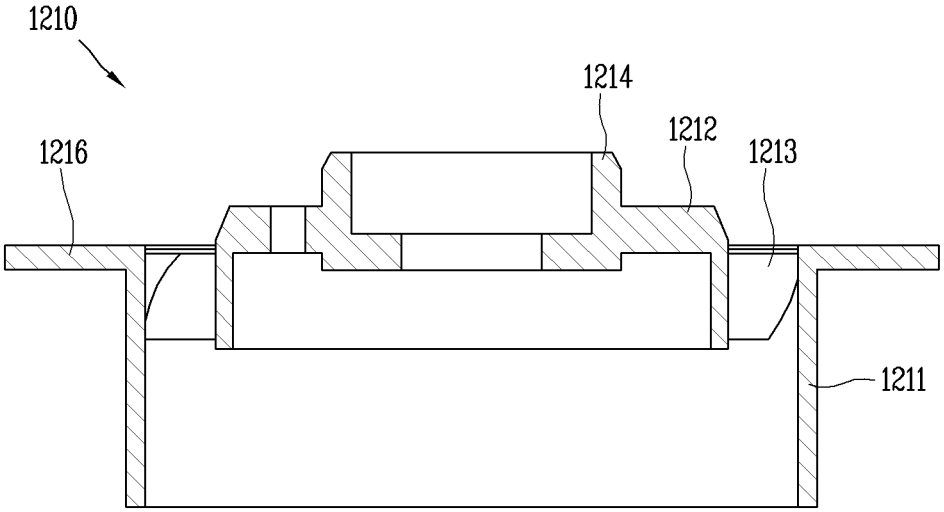
FIG. 4 is a cross-sectional view illustrating the second housing cover of FIG. 3.

FIG. 3 is a perspective view of the second housing cover 1210. FIG. 4 is a cross-sectional view of the second housing cover 1210 of FIG. 3.

As described above, the second housing cover 1210 can be mounted to the lower portion of the housing 100.

The second housing cover 1210 can include the outer cover 1211, a second flange 1216, the first inner hub 1212, the second bearing accommodating portion 1214, and a plurality of housing cover blades 1213.

The outer cover 1211 can have a hollow cylindrical shape. The outer cover 1211 can define an outer surface of the second housing cover 1210. The outer cover 1211 can have a constant or identical diameter in the up-and-down direction.

The second flange 1216 can extend radially outward from an upper end of the outer cover 1211. Here, the first flange 103 (see FIG. 2) formed at the housing 100 and the second flange 1216 can be disposed to overlap in the up-and-down direction. However, a diameter of the second flange 1216 can be slightly less than a diameter of the first flange 103.

Here, a thickness of the first flange 103 can be greater than a thickness of the second flange 1216.

A flange accommodating groove can be formed in a lower surface of the first flange 103 in a concave manner. The flange accommodating groove can accommodate the second flange 1216 therein. The flange accommodating groove and the second flange 1216 can be coupled to each other.

The first flange 103 and the second flange 1216 can each include a plurality of fastening holes. The plurality of fastening holes can be formed through the first flange 103 and the second flange 1216 in a thickness direction.

The plurality of fastening holes can be spaced apart from one another in a circumferential direction of the first flange 103, and the plurality of fastening holes can be spaced apart from one another in a circumferential direction of the second flange 1216.

With this configuration, the first flange 103 and the second flange 1216 can be coupled to each other. Fastening members, such as a screw, can respectively pass through the plurality of fastening holes to be fastened to the first flange 103 and the second flange 1216, allowing the second housing cover 1210 to be coupled to the lower portion of the housing 100.

The first inner hub 1212 can have a cylindrical shape. A diameter of the first inner hub 1212 can be less than a diameter of the outer cover 1211.

The upper portion of the first inner hub 1212 can be closed (or blocked) and the lower portion of the first inner hub 1212 can be open.

An axial length of the outer cover 1211 can be greater than an axial length of the first inner hub 1212.

An upper end portion of the first inner hub 1212 can protrude upward from an upper end thereof. A center of the first inner hub 1212 can coincide with a center of the outer cover 1211.

The second bearing accommodating portion 1214 can be provided at the upper end portion of the first inner hub 1212. The second bearing accommodating portion 1214 can protrude upward from the upper end portion of the first inner hub 1212.

The second bearing accommodating portion 1214 can accommodate the second bearing 135 therein.

The second bearing accommodating portion 1214 can be open upward. Through this open upper portion, the second bearing 135 can be accommodated in the second bearing accommodating portion 1214.

The second bearing 135 can be configured as a ball bearing. A second holder 1351 with a circular ring shape can be coupled to an outer circumferential surface of the second bearing 135 so as to surround the second bearing 135.

A second O-ring 1352 can be installed on an outer circumferential surface of the second holder 1351. One or a plurality of second O-rings 1352 can be provided.

The plurality of second O-rings 1352 can be spaced apart from each other in a lengthwise direction of the second holder 1351.

Since the configurations of the second O-ring 1352 and the second holder 1351 are similar or equal to the configurations of the first O-ring 1342 and the first holder 1341, a redundant description will be omitted.

In the depicted example, the first O-ring 1342 is provided at an outer surface of the first holder 1341, and the second O-ring 1352 is provided at an outer surface of the second holder 1351. However, the present disclosure is not limited thereto. For example, the first O-ring 1342 can be provided at the outer surface of the first holder 1341, and the second O-ring 1352 may not be provided at the outer surface of the second holder 1351. In some examples, the first O-ring 1342 may not be provided at the outer surface of the first holder 1341, and the second O-ring 1352 can be provided at the outer surface of the second holder 1351.

A wave washer 1215 can be accommodated in the second bearing accommodating portion 1214. The wave washer 1215 can have a wavy ring shape. The wave washer 1215 can be disposed between an inner bottom surface of the second bearing accommodating portion 1214 and the second bearing 135.

The wave washer 1215 can reduce a surface pressure by evenly distributing pressure of the second bearing 135.

The second O-ring 1352 can allow the second bearing 135 to be coupled to an inner surface of the second bearing accommodating portion 1214 in a close contact manner. Like a spring washer, the wave washer 1215 can serve to restrict the second bearing 135 from being released or separated from the second bearing accommodating portion 1214.

The plurality of housing cover blades 1213 can be provided in an annular space between the inner circumferential surface of the outer cover 1211 and an outer circumferential surface of the first inner hub 1212.

The plurality of housing cover blades 1213 can each protrude from the outer circumferential surface of the first inner hub 1212 to the inner circumferential surface of the outer cover 1211.

The plurality of housing cover blades 1213 can each protrude from the outer circumferential surface of the first inner hub 1212 in a manner of extending obliquely downward from the upper portion of the first inner hub 1212. The housing cover blade 1213 can be configured as an axial flow type.

The plurality of housing cover blades 1213 is configured to connect the outer cover 1211 and the first inner hub 1212. Inner ends of the plurality of housing cover blades 1213 can be connected to the outer circumferential surface of the first inner hub 1212, and outer ends of the plurality of housing cover blades 1213 can be connected to the inner circumferential surface of the outer cover 1211.

The plurality of housing cover blades 1213 can be disposed to be spaced apart from one another in a circumferential direction of the first inner hub 1212.

The plurality of housing cover blades 1213 can be fixed between the outer cover 1211 and the first inner hub 1212.

That is, as the housing cover blade 1213 is configured as the axial flow type to thereby serve as an axial flow vane, a radial length of the second housing cover 1210 can be reduced compared to when a diagonal flow vane is employed. This can result in reducing an air flow length. Thus, the size and weight of the fan motor can be reduced compared to when the diagonal flow vane is applied. Further, interference in the flow of air can be prevented or reduced.

As the second housing cover 1210 is provided in parallel along the axial direction, a mold can be easily removed in the up-and-down direction to thereby facilitate manufacturing. This can lead to a simpler manufacturing process of the second housing cover 1210, allowing economic feasibility of mass production to be achieved.

Figure 5:
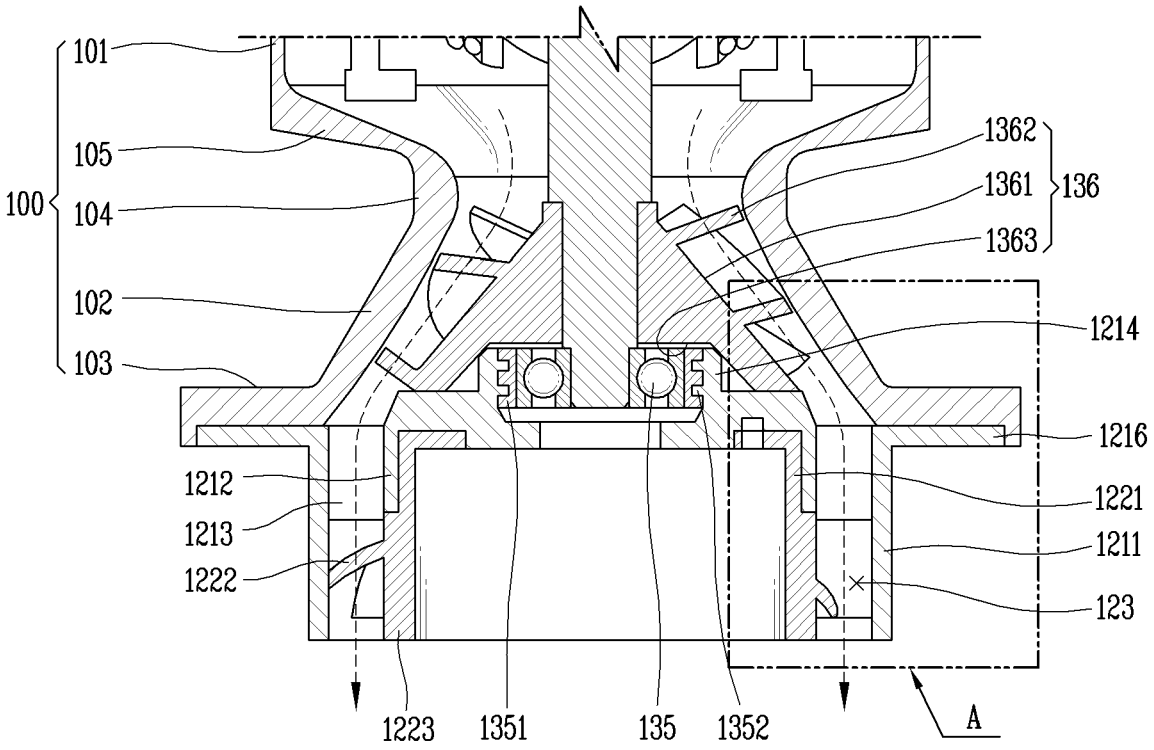
FIG. 5 is a schematic view illustrating an example of a flow of air through an example impeller and an example second housing cover which are installed inside an example housing.
Figure 6:
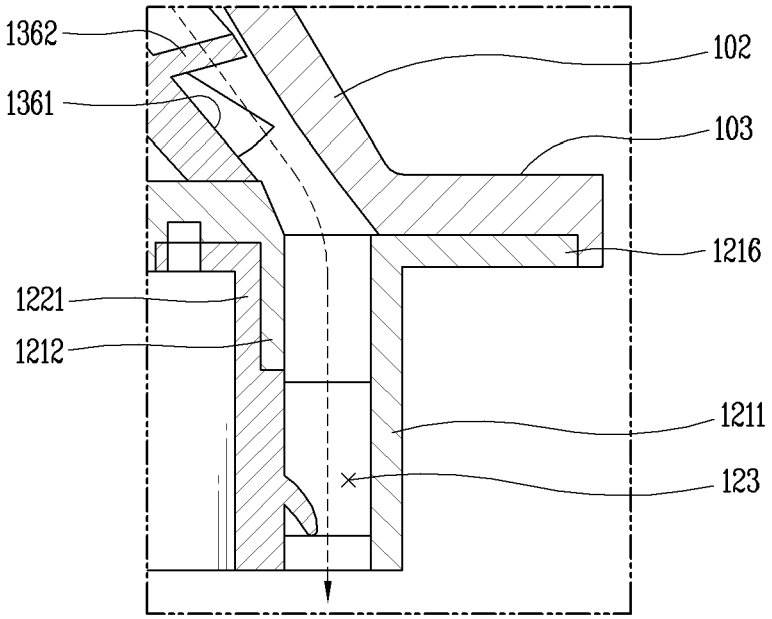
FIG. 6 is an enlarged view of area A of FIG. 5.

FIG. 5 is a schematic view illustrating a flow of air when the impeller 136 and the second housing cover 1210 are installed inside the housing 100, and FIG. 6 is an enlarged view of area A of FIG. 5.

The impeller hub 1361 of the impeller 136 configured as a diagonal flow type can have a conical shape with a diameter that gradually increases from the top toward the bottom. For example, the diagonal flow type impeller can blow air in a diagonal direction with respect to a rotational axis of the impeller.

The housing cover blades 1213 and the vane blades 1222 of the vane 1220 are arranged to be aligned with each other inside the second housing cover 1210, allowing air suctioned by the impeller 136 to move to the outside of the housing 100.

When taking a close look at the flow of air, air introduced through the lateral flow path 1253 of the inverter 1250 and the side hole 107 of the motor passes through the axial through-hole 1205 of the first housing cover 120 to flow into the stator assembly 110. After passing through the stator assembly 110, the air passes through the inclined portion 105 and the neck portion 104, passes through the impeller 136 and the housing cover blade 1213 of the second housing cover 1210, and then passes through the vane blade 1222 to be discharged outside.

In some implementations, as the second housing cover 1210 and the impeller 136 configured as the diagonal flow type are arranged vertically, and the housing cover blade 1213 provided on the second housing cover 1210 is configured as the axial flow type, a change in air flow angle caused by a bent air flow path when air flowing along the second housing cover 1210 passes through the second housing cover 1210 can be minimized, thereby reducing interference due to the flow of air.

In addition, the vane blades 1222 configured as the axial flow type and the housing cover blades 1213 are arranged in two layers (columns) in parallel to facilitate the flow of air, thereby minimizing flow resistance of air.

Further, as illustrated in FIG. 6, air flowing along the inside of the housing 100 after passing through the rotor assembly 130 and the stator assembly 110 can come or join at the inclined portion 105. The air that has passed through the neck portion 104 where a cross-sectional area of the flow path is gradually narrowed flows to the upstream side of the impeller 136. The air that has passed through the neck portion 104 receives a rotational force from the impeller 136 to move along an axial direction of the second accommodating portion 102.

The housing cover blade 1213 and the vane blade 1222 of the second housing cover 1210 are respectively configured as an axial flow type, allowing a flow direction of air that has passed through the impeller 136 to be guided in the axial direction.

That is, the air that has passed through the impeller 136 sequentially passes through the housing cover blade 1213 and the vane blade 1222 of the second housing cover 1210 and is then discharged to the outside of the housing 100, allowing air to blow in one direction.

Figure 7:
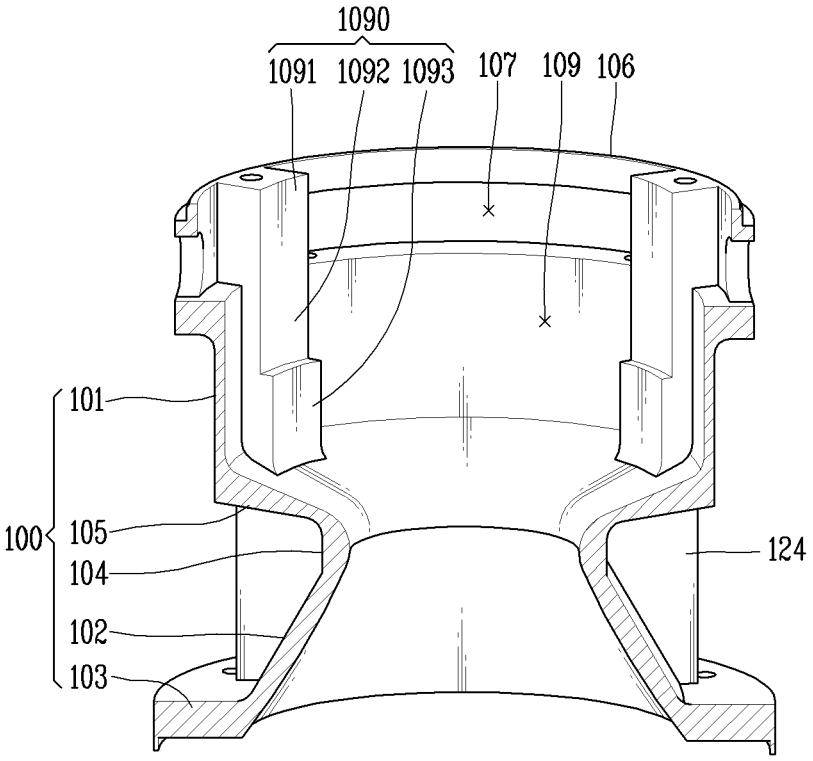
FIG. 7 is a cut-away view illustrating an inside of the housing.
Figure 8A:
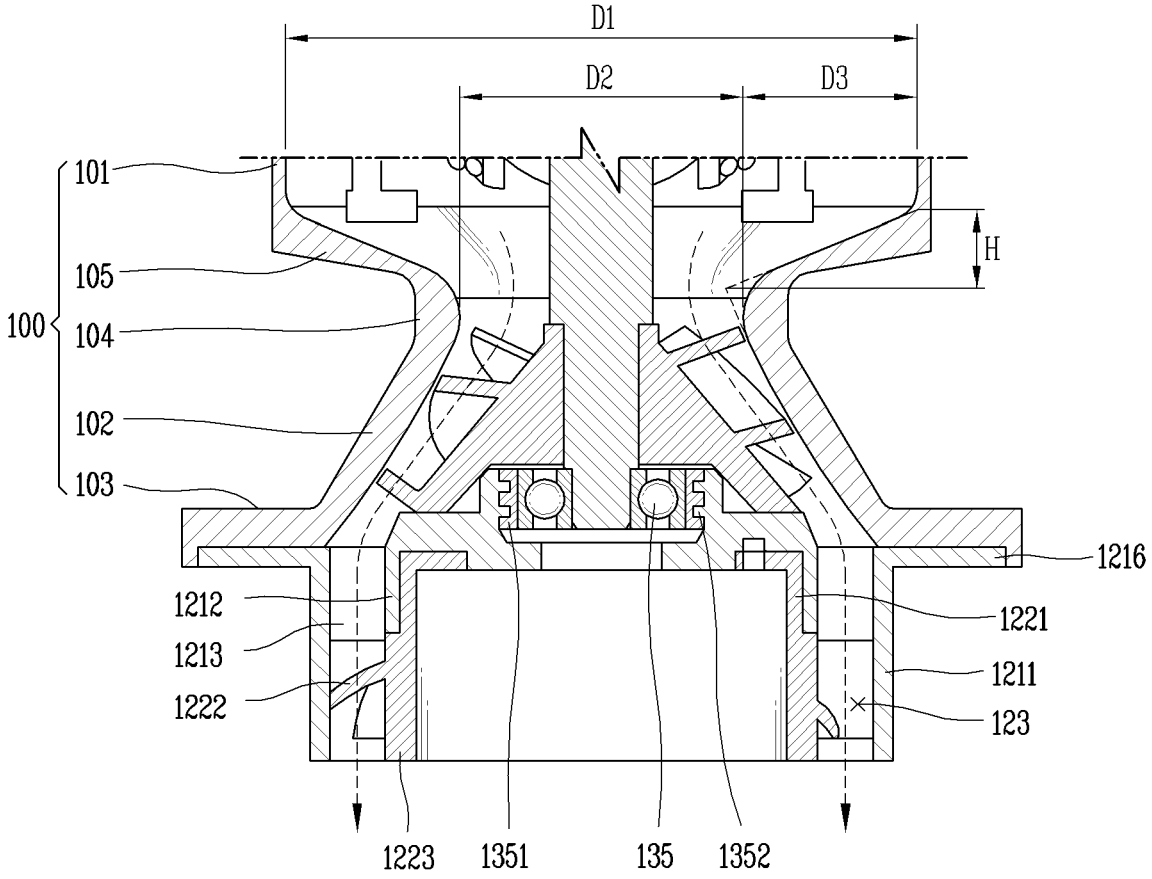
FIG. 8A is a cross-sectional view illustrating an inside of the housing.
Figure 8B:
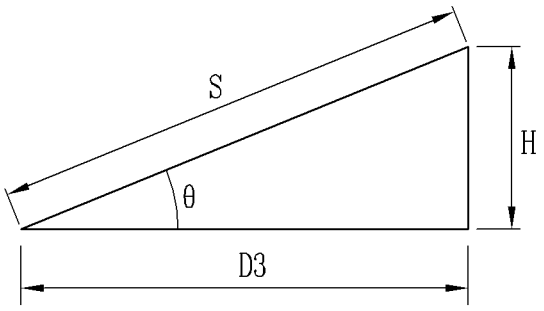
FIG. 8B is a schematic view illustrating an inclination (0) of an example of an inclined portion of the housing represented by a triangle.

FIG. 7 is a cut-away view illustrating an inside of the housing 100, FIG. 8A is a FIG. 8A is a cross-sectional view illustrating an inside of the housing 100, and FIG. 8B is a schematic view illustrating an inclination (θ) of an inclined portion of the housing 100 represented by a triangle, which is determined by a half value of the difference between an inner diameter (D1) of a first accommodating portion and an inner diameter (D2) of a neck portion, and a height difference (H) between front and rear ends of the inclined portion.

As described above, the neck portion 104 can be formed at the housing 100 and be provided between the first accommodating portion 101 and the second accommodating portion 102. The diameter of the neck portion 104 can be less than the diameter of the first accommodating portion 101.

The inclined portion 105 can be formed between the lower end of the first accommodating portion 101 and the neck portion 104, and a diameter of the inclined portion 105 can gradually decrease from the first accommodating portion 101 toward the neck portion 104.

In detail, the inclined portion 105 can extend from the lower end of the first accommodating portion 101 in the circumferential direction and be inclined downward from the lower end of the first accommodating portion 101 to the neck portion 104.

The inclined portion 105 can be located at a central portion of the housing 100 in the lengthwise direction.

Outer and inner surfaces of the inclined portion 105 can be inclined at different inclinations.

The inner surface of the inclined portion 105 can be more inclined than the outer surface thereof.

An inner portion or point to which the first accommodating portion 101 and the inclined portion 105 are connected can be rounded in a curved shape.

With this configuration, flow resistance of air flowing from the first accommodating portion 101 to the inclined portion 105 can be minimized.

An inner surface of the neck portion 104 can be rounded in a curved shape.

A curvature of the neck portion 104 can be less than a curvature of the connected portion of the first accommodating portion 101 and the inclined portion 105.

With this configuration, an inner curved surface of the neck portion 104 is curved, and thus, the air flow resistance can be minimized when air passes through the neck portion 104 from the first accommodating portion 101 toward the second accommodating portion 102.

The neck portion 104 can be connected to an upper end portion of the second accommodating portion 102. The neck portion 104 is a portion that is the smallest in diameter of the internal flow path penetrating through the housing 100.

A plurality of support parts 1090 can be provided inside the housing 100. The plurality of support parts 1090 is in contact with an outer circumferential surface of the stator core 111 to support the stator core 111.

The plurality of support parts 1090 can protrude radially inward from an inner circumferential surface of the first accommodating portion 101.

The plurality of support parts 1090 can be spaced apart from each other in a circumferential direction of the housing 100. The plurality of support parts 1090 can be disposed to be spaced apart from one another with the same intervals in the circumferential direction.

In some implementations, three support parts 1090 are provided, and the plurality of support parts 1090 can be disposed to be 120 degrees apart from one another along the circumferential direction.

The plurality of bypass flow paths 109 and the plurality of support parts 1090 can be alternately disposed in the circumferential direction of the housing 100.

The support parts 1090 can include first to third support portions 1091 to 1093.

The first support portion 1091 can protrude radially inward from the inner circumferential surface of the intake port 106. A plurality of first support portions 1091 can be disposed between the plurality of side holes 107.

The second support portion 1092 can be provided at a lower portion of the first support portion 1091.

The second support portion 1092 can extend downward from the upper end of the first accommodating portion 101. The second support portion 1092 can protrude radially inward from the inner circumferential surface of the first accommodating portion 101. A plurality of second support portions 1092 is configured to support an outer circumferential surface of the back yoke 112 of the stator core 111.

The third support portion 1093 can be provided at a lower portion of the second support portion 1092.

The third support portion 1093 can protrude radially outward from the inner circumferential surface of the first accommodating portion 101.

The third support portion 1093 can further protrude radially outward from a lower end of the second support portion 1092.

As illustrated in FIG. 1, air is introduced through the lateral flow path 1253 of the inverter 1250 and the side hole 107 of the motor and then passes through the stator assembly 110 through the axial through-hole 1205 of the first housing cover 120. Thereafter, as illustrated in FIG. 8A, the air passes through the inclined portion 105 and the neck portion 104, passes through the housing cover blade 1213 of the second housing cover 1210 and the vane blade 1222, and is then discharged outside.

Here, the inclined portion 105 can have a tapered shape with a decreasing diameter from the first accommodating portion 101 to the neck portion 104, and an angle θ of the inclined portion 105 can be determined by a half value D3 of the difference between an inner diameter D1 of the first accommodating portion 101 and an inner diameter D2 of the neck portion 104, and a height difference H between front and rear ends of the inclined portion 105.

In detail, as shown in FIGS. 8A and 8B, the angle θ of the inclined portion 105 can be determined by the Equation $\theta=\tan^{-1}(H/D3)$, where $D3=(D1-D2)/2$.

Here, D1 denotes an inner diameter of the first accommodating portion, D2 denotes an inner diameter of the neck portion, and H denotes a height difference between the front and rear ends of the inclined portion.

That is, the fan motor according to the present disclosure has a structure in which the second housing cover 1210 is installed in parallel with the diagonal flow impeller 136, and the housing cover blade 1213 provided at the second housing cover 1210 is configured as the axial flow type, thereby minimizing a change in air flow angle caused when an air flow path is bent as air flowing along the impeller 136 passes through the second housing cover 1210. This can result in reducing interference due to the flow of air to thereby prevent or reduce a decrease in fan efficiency.

In some examples, the rotating shaft 131 can rotated at a high speed, for example, at 100,000 rpm or higher, and the rotating shaft 131 can be supported by the first bearing 134 and the second bearing 135 that respectively support the both ends of the rotating shaft 131.

More specifically, the first and second bearings 134 and 135 are securely supported by the first bearing accommodating portion 1203 of the first housing cover 120 and the second bearing accommodating portion 1214 of the second housing cover 1210, respectively. This can result in suppressing impact from being applied to the bearings to thereby prevent a reduction in lifespan of the bearings.

Thus, even when the first bearing 134 and the second bearing 135 that respectively support the both ends of the rotating shaft 131 are located far from each other, due to the motor design, the rotating shaft 131 can be securely supported during high-speed rotation of the motor.

As a distance from the rotor assembly 130 to the first bearing 134, and a distance from the rotor assembly 130 to the second bearing 135 are different, and the impeller 136 is disposed adjacent to the second bearing 135, shock or impact can be absorbed in a more stable manner, allowing the bearings to be securely held in position during the high-speed rotation of the motor.

As described above, the first bearing 134 can be configured as a ball bearing, and the first holder 1341 can be coupled to the outer circumferential surface of the first bearing 134. The first holder 1341 can have a cylindrical shape.

As the first O-ring 1342 is installed at the outer circumferential surface of the first holder 1341, vibration caused by the high-speed rotation of the motor can be prevented or reduced, and self-aligning can be achieved.

As the first O-ring 1342 is provided in plurality, vibration and impact transferred to the first bearing 134 can be more smoothly absorbed.

Here, the second bearing 135 can be configured as a ball bearing made up of an outer ring, an inner ring, and a plurality of balls. The second bearing 135 can have a structure in which an O-ring is installed inside an O-ring holder like the first bearing 134.

In the fan motor 1000, since air introduced as the impeller 136 rotates first comes into contact with the stator assembly 110 and the rotor assembly 130, heat generated by operation of the motor can be cooled, allowing heat generated by the high-speed rotation of the motor to be more effectively removed.

In some implementations, a flow path of air introduced is configured to be different from a flow path of other fan motors. For examples, air introduced from the outside first comes in contact with the stator assembly 110 and the rotor assembly 130 to thereby increase the cooling efficiency of the motor with air. In addition, as the bearings are supported by the first housing cover 120 and the second housing cover 1210, and the second housing cover 1210 of the axial flow type is located at a position adjacent to the second housing cover 1210 of the diagonal flow impeller 136, a flow loss can be reduced due to a reduction in flow length of air. Further, a radial length of the housing 100 can be reduced due to application of the axial flow type second housing cover 1210, thereby achieving the size and weight reduction of the motor.

The foregoing implementations are merely given of those implementations for practicing a fan motor according to the present disclosure. Therefore, the present disclosure is not limited to the above-described implementations, and it will be understood by those of ordinary skill in the art that various changes in form and details can be made therein without departing from the scope of the present disclosure.

What is claimed is:

1. A fan motor comprising:

a housing;

a stator assembly disposed inside the housing;

a rotor assembly rotatably disposed inside the stator assembly;

an impeller configured to generate a flow of air in the housing based on receiving power from the rotor assembly, the impeller being a diagonal flow impeller;

a first housing cover disposed at one side of the housing;

a first bearing disposed in the first housing cover;

a second housing cover disposed at another side of the housing and configured to guide the flow of the air along an axial direction of the impeller, the impeller and the second housing cover being arranged along the axial direction;

a second bearing disposed in the second housing cover; and a vane assembly disposed at a lower portion of the second housing cover and configured to guide the flow of the air in the second housing cover, wherein the second housing cover comprises:

an outer cover, a first inner hub disposed inside the outer cover, a bearing accommodating portion that protrudes from one side of the first inner hub toward the impeller and accommodates the second bearing, and a plurality of housing cover blades that have a helical shape and protrude from an outer circumferential surface of the first inner hub to an inner circumferential surface of the outer cover to thereby connect the first inner hub to the outer cover.

2. The fan motor of claim 1, wherein the plurality of housing cover blades radially extend and are inclined toward the housing by a predetermined angle with respect to the inner circumferential surface of the outer cover, each of the plurality of housing cover blades being configured to guide the flow of air generated by the impeller.

3. The fan motor of claim 1, wherein the vane assembly comprises:

a second inner hub accommodated in the first inner hub; and a plurality of vane blades that have a helical shape and protrude from an outer circumferential surface of the second inner hub toward the inner circumferential surface of the outer cover.

4. A fan motor, comprising:

a housing;

a stator assembly disposed inside the housing;

a rotor assembly rotatably disposed inside the stator assembly;

an impeller configured to generate a flow of air in the housing based on receiving power from the rotor assembly, the impeller being a diagonal flow impeller;

a first housing cover disposed at one side of the housing;

a first bearing disposed in the first housing cover;

a second housing cover disposed at another side of the housing and configured to guide the flow of the air along an axial direction of the impeller, the impeller and the second housing cover being arranged along the axial direction;

a second bearing disposed in the second housing cover; and a vane assembly disposed at a lower portion of the second housing cover and configured to guide the flow of the air in the second housing cover, wherein the housing comprises:

a first accommodating portion that accommodates the rotor assembly and the stator assembly, a second accommodating portion that is disposed vertically below the first accommodating portion and accommodates the impeller, a neck portion disposed between the first accommodating portion and the second accommodating portion, a diameter of the neck portion being less than a diameter of the first accommodating portion, and an inclined portion that is inclined with respect to the first accommodating portion and extends from the first accommodating portion toward the neck portion.

5. The fan motor of claim 4, wherein the inclined portion has a tapered shape, and wherein a diameter of the inclined portion decreases from the first accommodating portion toward the neck portion.

6. The fan motor of claim 4, wherein an inclination angle (θ) of the inclined portion with respect to a radial direction is determined by (i) a half value (D3) of a difference between an inner diameter (D1) of the first accommodating portion and an inner diameter (D2) of the neck portion and (ii) a height difference (H) between an upper end of the inclined portion facing the first accommodating portion and a lower end of the inclined portion facing the neck portion.

7. The fan motor of claim 6, wherein the inclination angle θ of the inclined portion is determined by Equation $D3=(D1-D2)/2$.

* * * * *